US007762102B2

(12) United States Patent
Hamel et al.

(10) Patent No.: US 7,762,102 B2
(45) Date of Patent: Jul. 27, 2010

(54) SOFT FREEZE ASSEMBLY FOR A FREEZER STORAGE COMPARTMENT

(75) Inventors: Tim A. Hamel, Louisville, KY (US); Mark W. Wilson, Simpsonville, KY (US); Alexander Pinkus Rafalovich, Louisville, KY (US); Sathi Bandaru, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 652 days.

(21) Appl. No.: 11/646,802

(22) Filed: Dec. 28, 2006

(65) Prior Publication Data

US 2008/0156006 A1 Jul. 3, 2008

(51) Int. Cl.
*F25D 11/02* (2006.01)
*F24D 19/10* (2006.01)

(52) U.S. Cl. ..... 62/443; 62/441; 62/445; 236/91 D

(58) Field of Classification Search ..... 62/173, 62/159, 90, 163, 177, 180, 187, 441, 443, 62/445, 449; 236/91 D
See application file for complete search history.

(56) References Cited

U.S. PATENT DOCUMENTS 3,638,717 A * 2/1972 Harbour et al. ..... 165/263
4,358,932 A * 11/1982 Helfrich, Jr. ..... 62/126
5,839,287 A 11/1998 Stormo
6,327,867 B1 12/2001 Hyodo et al.
6,497,113 B1 12/2002 Yamada et al.
6,612,116 B2 9/2003 Fu et al.
7,032,407 B2 4/2006 Chastine
7,051,539 B2 5/2006 Junge et al.
7,051,549 B2 5/2006 Kim et al.
7,191,827 B2 3/2007 Junge et al.
2003/0115892 A1* 6/2003 Fu et al. ..... 62/187
2006/0086126 A1 4/2006 Montuoro
2006/0266069 A1 11/2006 Choi et al.

* cited by examiner

*Primary Examiner*—Frantz F Jules
*Assistant Examiner*—Travis Ruby
(74) *Attorney, Agent, or Firm*—George L. Rideout, Esq.; Armstrong Teasdale LLP

(57) ABSTRACT

A soft freeze assembly for a refrigerator including a freezer storage compartment having a first temperature includes a second storage compartment positioned within the freezer storage compartment. A heat source is positioned with respect to the second storage compartment and configured to heat air within the second storage compartment to a second temperature greater than the first temperature within the freezer storage compartment. A controller is in operational control communication with the heat source and configured to operate the heat source.

18 Claims, 5 Drawing Sheets

SOFT FREEZE ASSEMBLY FOR A FREEZER STORAGE COMPARTMENT

BACKGROUND OF THE INVENTION

This invention relates generally to refrigeration appliances and, more particularly, to apparatus and methods for freezing foods within a storage compartment of the refrigeration appliance.

Many conventional household refrigeration appliances include a freezer storage compartment and a fresh food storage compartment, either arranged in a side-by-side configuration and separated by a center mullion wall, or in an over-and-under configuration and separated by a horizontal center mullion wall. A freezer door and a fresh food door close the access openings to the freezer storage compartment and the fresh food storage compartment, respectively.

At least some conventional refrigeration appliances provide a substantially even temperature within the freezer storage compartment. However, it may be desirable to rapidly cool and/or store certain food items at a temperature different than the temperature within the freezer storage compartment to prevent ice crystal growth, which may damage the freshness of the food items. Further, it may be desirable to maintain certain food items, such as meat products or dairy products, at a soft freeze state (i.e., not completely frozen) for facilitating cutting or serving the food items.

BRIEF DESCRIPTION OF THE INVENTION

In one aspect, a soft freeze assembly is provided for a refrigerator including a freezer storage compartment having a first temperature. The soft freeze assembly includes a second storage compartment positioned within the freezer storage compartment. A heat source is positioned with respect to the second storage compartment and configured to heat air within the second storage compartment to a second temperature greater than the first temperature within the freezer storage compartment. A controller is in operational control communication with the heat source and configured to operate the heat source.

In another aspect, a refrigerator is provided. The refrigerator includes a freezer storage compartment having a first temperature. A soft freeze assembly is mounted within the freezer storage compartment. The soft freeze assembly includes a second storage compartment. A heat source is positioned with respect to the second storage compartment and configured to heat air within the second storage compartment to a second temperature greater than the first temperature within the freezer storage compartment. A thermistor is positioned with respect to the second storage compartment and configured to detect a temperature within the second storage compartment. A controller is in signal communication with the thermistor. The controller is in operational control communication with the heat source and configured to maintain the second temperature within the second storage compartment independent from the first temperature within the freezer storage compartment.

In another aspect, a method for freezing a food item within a refrigerator is provided. The method includes providing a freezer storage compartment having a first temperature. A soft freeze assembly is positioned within the freezer compartment. The soft freeze assembly includes a second storage compartment, a heat source configured to heat air within the second storage compartment, and a thermistor positioned with respect to the second storage compartment. The thermistor is configured to detect a temperature within the second storage compartment. A controller is operatively coupled to the thermistor. The controller is configured to maintain a second temperature within the second storage compartment independent from the first temperature within the freezer storage compartment.

DETAILED DESCRIPTION OF THE INVENTION

The present invention provides a system and method for independently controlling a temperature within a soft freeze assembly positioned within a refrigerator freezer storage compartment. A consumer is able to interface with a soft freeze control to activate a soft freeze mode. The soft freeze mode maintains air within a soft freeze storage compartment at a desired temperature. As a result, food items contained within the soft freeze storage compartment are frozen to a desired hardness based at least partially on selected and/or inputted information. In one embodiment, the consumer selects or inputs a type of food, a hardness preference and/or a temperature such that the soft freeze mode operates to maintain the food items at the desired hardness.

Figure 1:
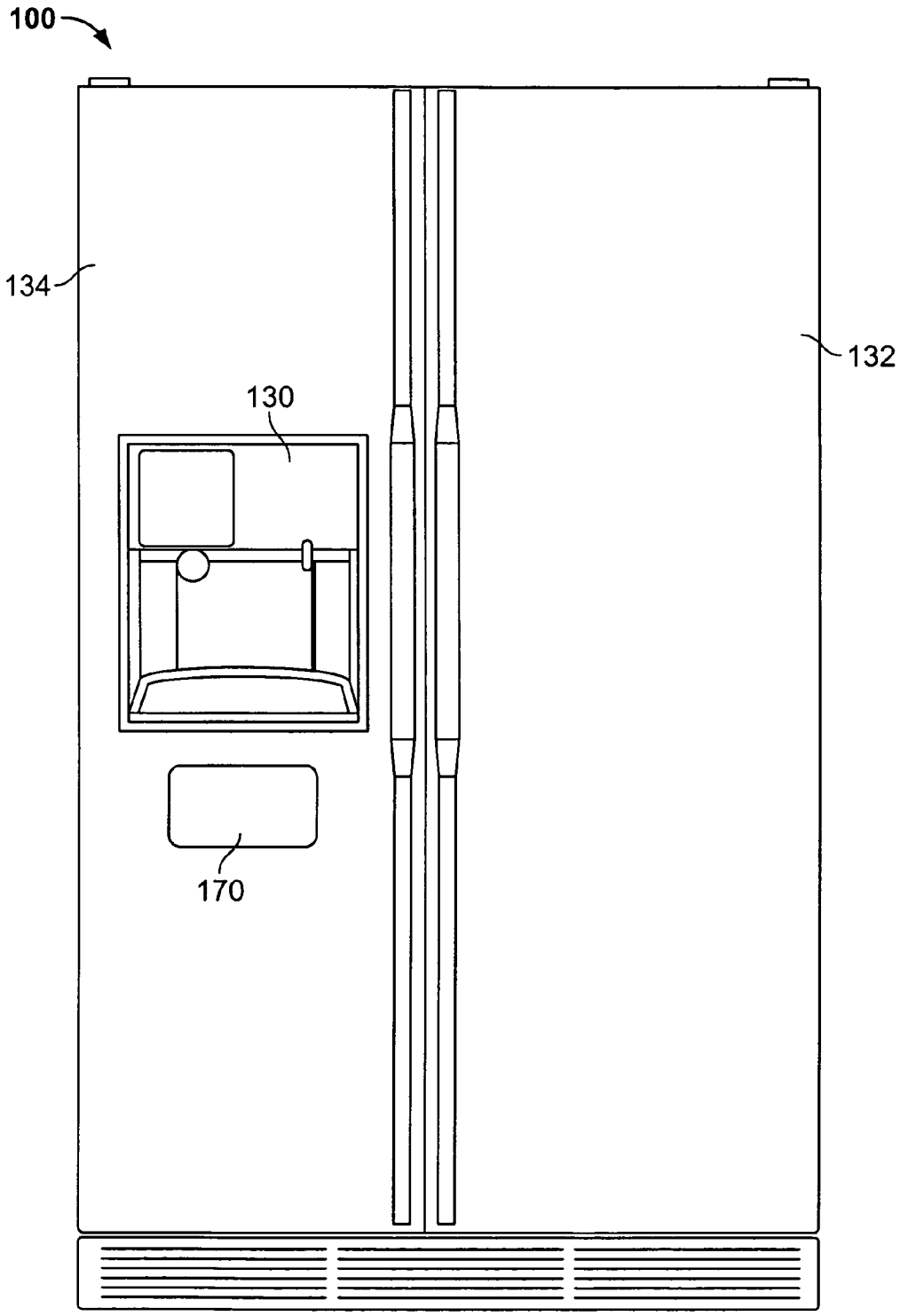
FIG. 1 is a front view of an exemplary refrigerator.
Figure 2:
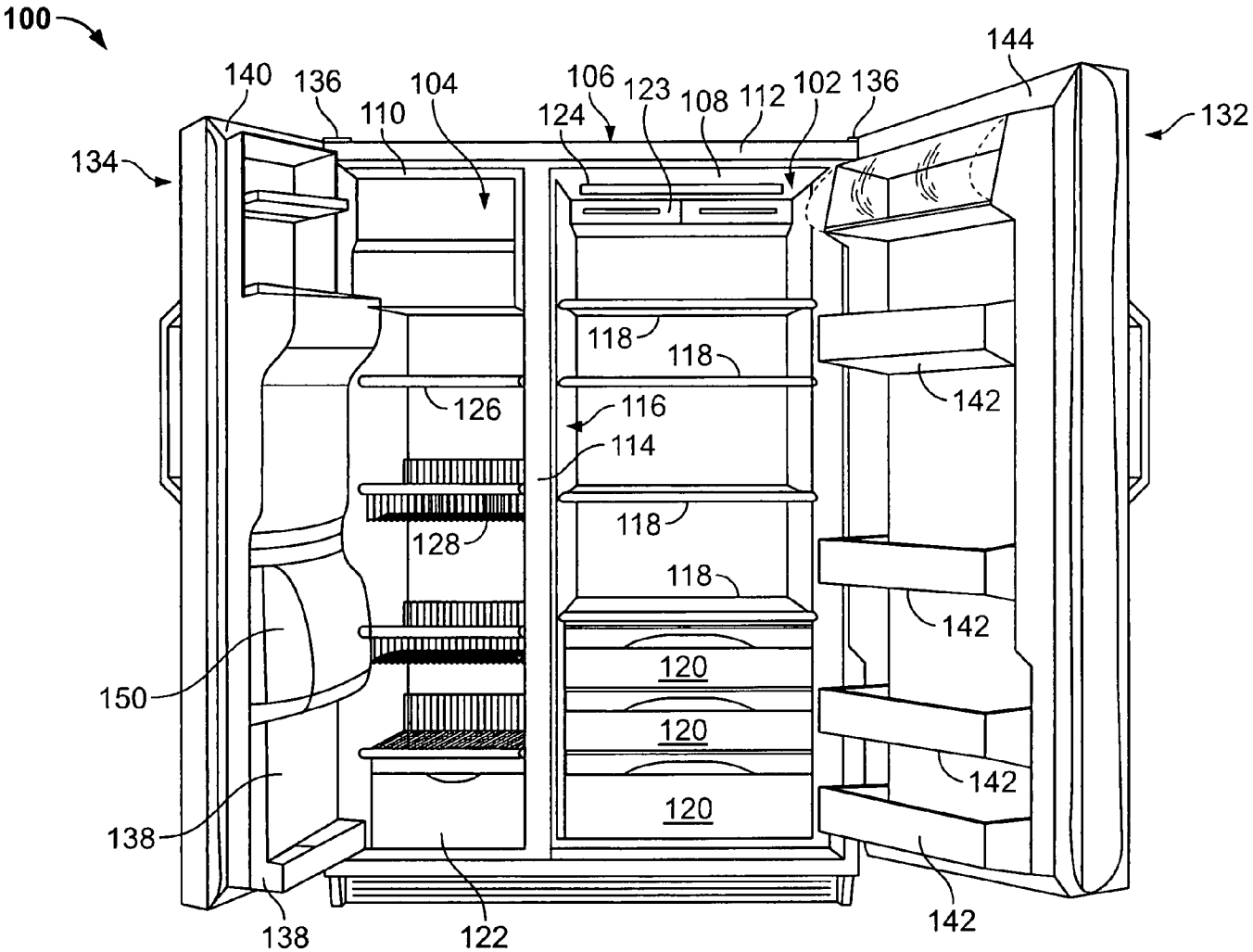
FIG. 2 is a perspective view of the refrigerator shown in FIG. 1.

FIGS. 1 and 2 illustrate a side-by-side refrigerator 100 in which exemplary embodiments of the present invention may be practiced and for which the benefits of the invention may be realized. It is recognized, however, that the benefits of the present invention may be achieved in other types of refrigerators, such as for example, over-and-under refrigerators. Therefore, the description set forth herein is for illustrative purposes only and is not intended to limit the invention in any aspect.

Referring further to FIG. 2, refrigerator 100 includes a fresh food storage compartment 102 and a freezer storage compartment 104 arranged side-by-side and contained within an outer case 106 and inner liners 108 and 110. A space between outer case 106 and inner liners 108 and 110, and between inner liners 108 and 110, is filled with foamed-in-place insulation. Outer case 106 normally is formed by folding a sheet of a suitable material, such as pre-painted steel, into an inverted U-shape to form top and side walls of case. A bottom wall of outer case 106 normally is formed separately and attached to the case side walls and to a bottom frame that provides support for refrigerator 100. Inner liners 108 and 110 are molded from a suitable plastic material to form fresh food storage compartment 102 and freezer storage compartment 104, respectively. Alternatively, inner liners 108, 110 may be formed by bending and welding a sheet of a suitable metal, such as steel. The illustrative embodiment includes two separate inner liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer storage compartment and a fresh food storage compartment.

A breaker strip 112 extends between a case front flange and outer front edges of inner liners 108, 110. Breaker strip 112 is formed from a suitable resilient material, such as an extruded acrylo-butadiene-styrene based material (commonly referred to as ABS).

The insulation in the space between inner liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of outer case 106 and vertically between inner liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food storage compartment 102 to support items being stored therein. Additionally, at least one shelf 126 and at least one wire basket 128 are also provided in freezer storage compartment 104.

A controller 130 is mounted with respect to refrigerator 100, and is programmed to perform functions described herein. In the exemplary embodiment, controller 130 is mounted to a fresh food door 132 or a freezer door 134, as shown in FIG. 1 and described below, such that controller 130 is easily accessible to the consumer. In alternative embodiments, controller 130 is mounted within fresh food storage compartment 102 or frozen food storage compartment. As used herein, the term controller is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

Fresh food door 132 and freezer door 134 close access openings to fresh food storage compartment 102 and freezer storage compartment 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. In the exemplary embodiment, freezer door 134 includes a plurality of storage shelves 138 and a sealing gasket 140 and fresh food door 132 includes a plurality of storage shelves 142 and a sealing gasket 144. Additionally, a soft freeze assembly 150 is positioned within freezer storage compartment 104. In the exemplary embodiment, soft freeze assembly 150 is coupled to freezer door 134, as shown in FIGS. 2-5.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cool air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 3:
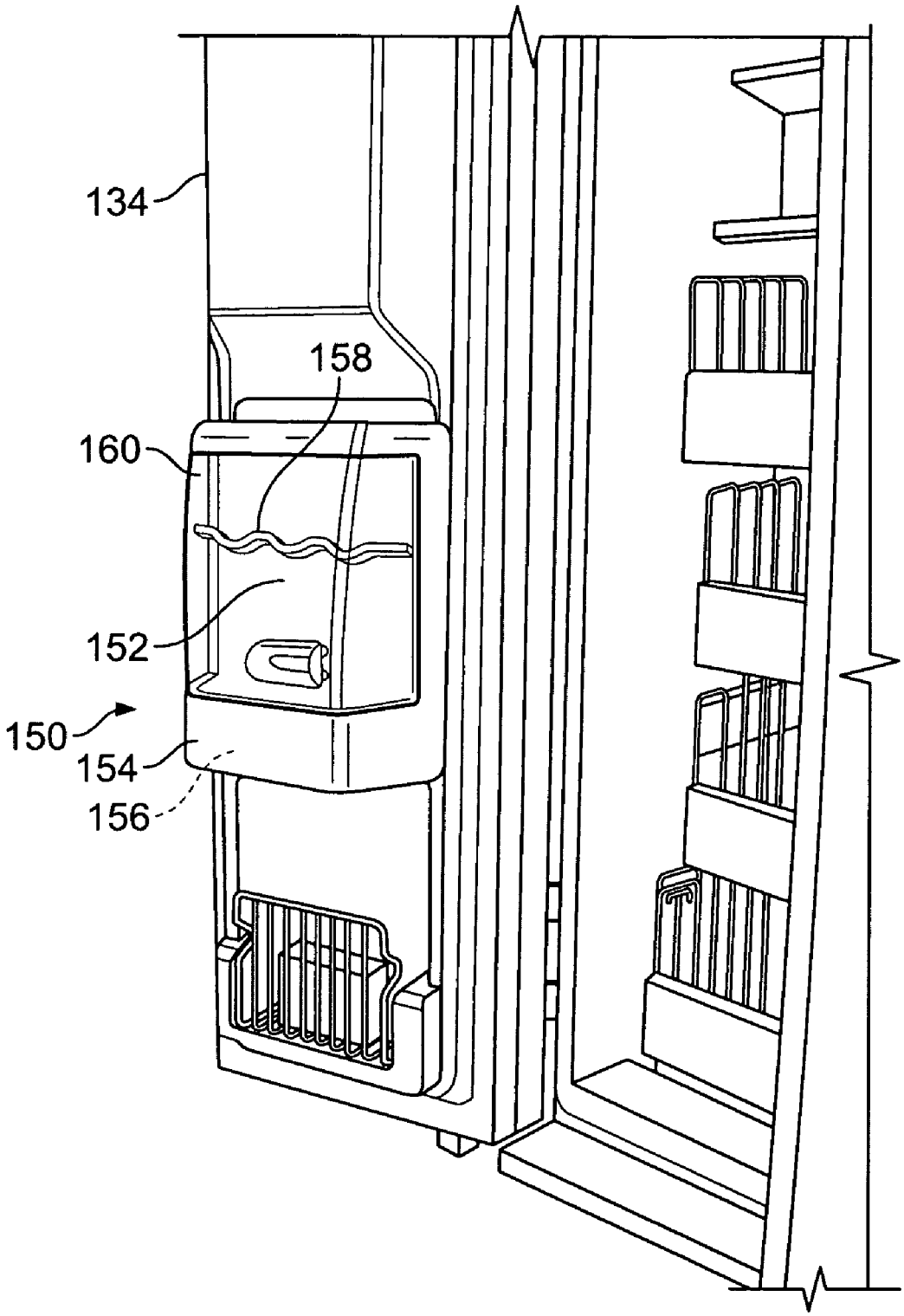
FIG. 3 is a perspective view of a portion of the refrigerator shown in FIG. 2 including an exemplary soft freeze assembly.
Figure 4:
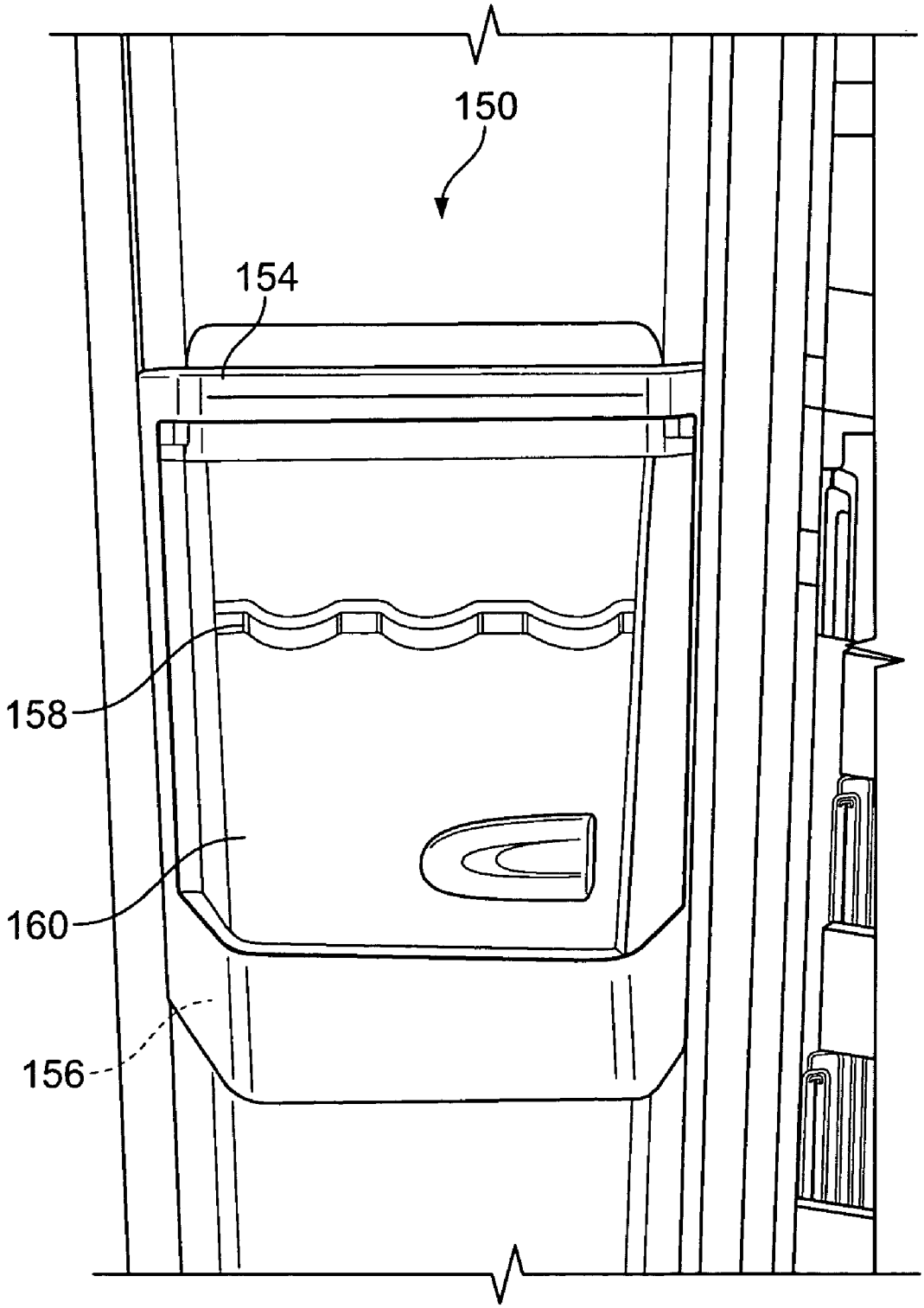
FIG. 4 is a front view of the soft freeze assembly shown in FIG. 3.
Figure 5:
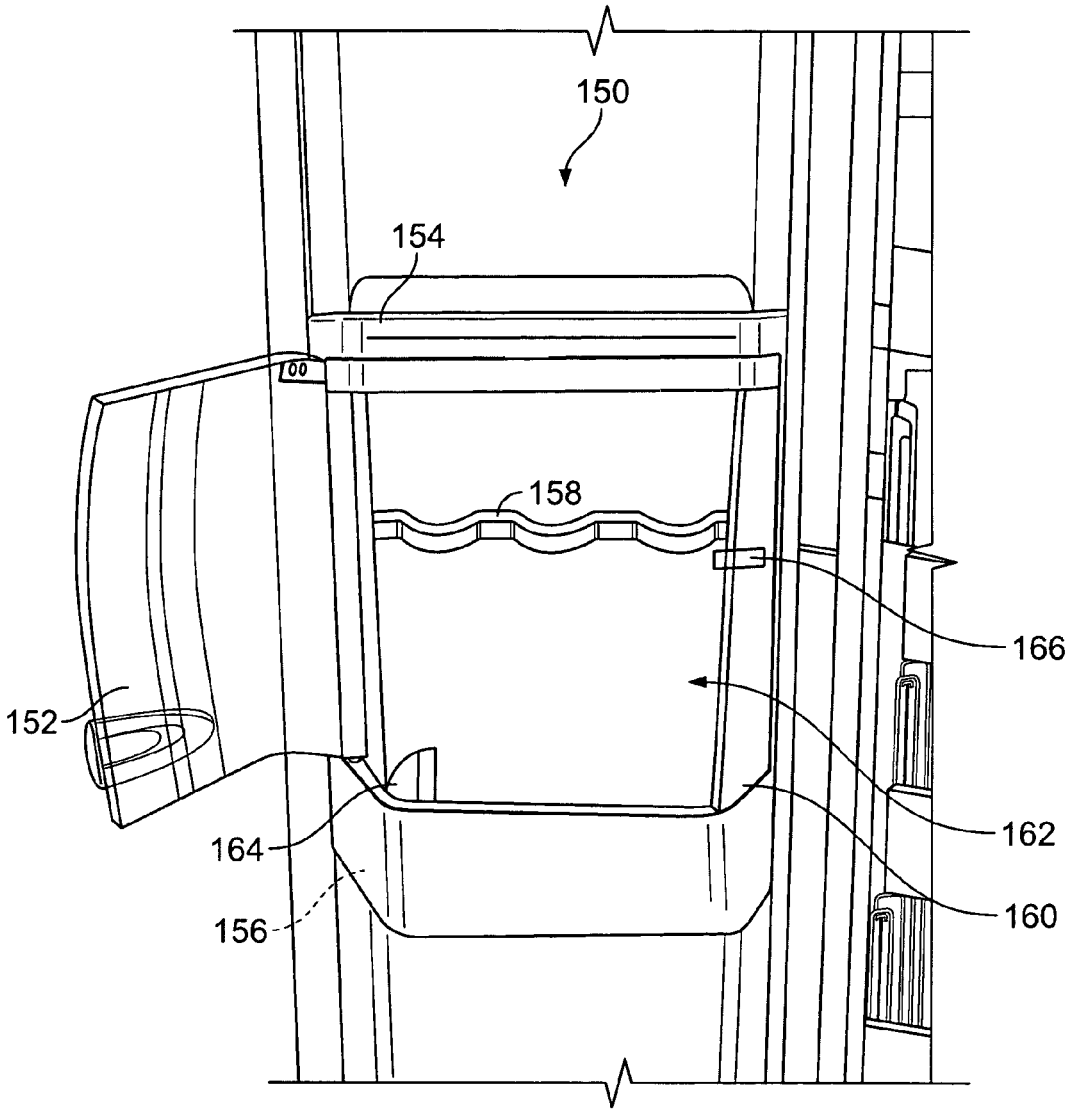
FIG. 5 is a front view of the soft freeze assembly shown in FIG. 3 with an access door in an open configuration.

FIG. 3 is a perspective view of a portion of freezer door 134 shown in FIG. 2 including soft freeze assembly 150. FIG. 4 is a front view of an exemplary soft freeze assembly 150 suitable for use with refrigerator 100 shown in FIGS. 1 and 2. FIG. 5 is a front view of the exemplary soft freeze assembly 150 shown in FIG. 4 with an access door 152 in an open configuration. Soft freeze assembly 150 includes a bin or storage compartment 154 thermally isolated from freezer storage compartment 104 and configured to contain food items. Storage compartment 154 is configured to at least partially define a volume of soft freeze assembly 150 having suitable dimensions for containing food items including, without limitation, meat products and/or diary products, such as ice cream. In the exemplary embodiment, storage compartment 154 includes a support tray 156 configured to receive food items. Additionally or alternatively, storage compartment 154 includes at least one shelf or rack 158 suitably configured to receive food items.

A transparent front panel 160 is coupled to storage compartment 154 to partially define the storage volume of soft freeze assembly 150. As shown in FIG. 5, front panel 160 defines an opening 162 providing access to storage compartment 154. Access door 152 is movably coupled, such as pivotally or slidably coupled, to front panel 160 and/or storage compartment 154 and movable between a closed configuration, as shown in FIG. 4, to facilitate maintaining storage compartment 154 at a desired or selected temperature and the open configuration, as shown in FIG. 5, to facilitate accessing food items.

At least one heating device is positioned with respect to soft freeze assembly 150 to facilitate maintaining a temperature within storage compartment 154 at a desired or selected temperature. In the exemplary embodiment, a heat source, such as a heater 164, is positioned within storage compartment 154 and operatively coupled to controller 130 for heating storage compartment 154 according to consumer manipulation through a control interface, such as a soft freeze control interface 170, shown schematically in FIG. 1. In a particular embodiment, controller 130, through soft freeze control interface 170, is in operational control communication with heater 164, as described in greater detail below. In an alternative embodiment, any suitable heat source known to those skilled in the art and guided by the teachings herein provided is positioned with respect storage compartment 154 and operatively coupled to controller 130 for heating storage compartment 154.

Additionally, at least one feedback device, such as a thermistor 166 or any suitable temperature sensor or detector, is positioned with respect to storage compartment 154 for sensing or detecting a temperature within storage compartment 154. In the exemplary embodiment, thermistor 166 is operatively coupled to controller 130 and/or soft freeze control interface 170. In a particular embodiment, thermistor 166 is in signal communication with controller 130 and is configured to transmit to controller 130 at least one signal related to or representative of a temperature sensed within storage compartment 154. In a further embodiment, thermistor 166 is configured to receive operational control signals from controller 130 and/or soft freeze control interface 170. As such, controller 130 is in operational control communication with heater 164 and in signal communication with thermistor 166 to control or regulate the temperature within storage compartment 154. In the exemplary embodiment, controller 130 activates heater 164 based on the signal received from thermistor 166.

In the exemplary embodiment, soft freeze control interface 170 is positioned on or within an outer surface of freezer door 134 such that a consumer can interface with soft freeze control interface 170 to control or regulate the temperature within soft freeze assembly 150 independently of the temperature within freezer storage compartment 104. Soft freeze control interface 170 is configured such that the consumer is able to select and/or input operational features and/or parameters during a soft freeze mode, as described in greater detail below. For example, in one embodiment, the consumer is able to select and/or input various soft freeze parameters including, without limitation, a food item type and/or weight, a desired hardness and/or a desired temperature within soft freeze assembly 150. As such, the consumer is able to control a wide range of operational parameters including a temperature within soft freeze assembly 150 separately and independently from controlling the operation of freezer storage compartment 104 with minimal impact on freezer performance and/or temperatures within freezer storage compartment 104. In one embodiment, soft freeze control interface 170 is operatively coupled to or integrated with controller 130. In an alternative embodiment, soft freeze control interface 170 is independently operational and includes a suitable control board, power supply, heater relay and/or thermistor input, for example.

In one embodiment, a fan assembly (not shown) is in flow communication with storage compartment 154 to direct air flow through storage compartment 154. During a standard cooling mode, controller 130 opens a damper that provides flow communication between freezer storage compartment 104 and soft freeze assembly 150 and activates the fan assembly to draw cool air into storage compartment 154. Controller 130 also deactivates heater 164. The cool air flows from the evaporator (not shown) into storage compartment 154. The cool air flows across the food item(s) positioned within storage compartment 154 and exits storage compartment 154 through air vents (not shown) defined within soft freeze assembly 150. During the standard cooling mode, the fan assembly directs cool air across the food item(s) positioned within storage compartment 154 to maintain a temperature within soft freeze assembly 150 substantially similar to a temperature within freezer storage compartment 104. In a particular embodiment, controller 130 monitors the temperature within soft freeze assembly 150 through thermistor 166.

Controller 130 activates or deactivates the fan and/or opens or closes the damper when the sensed temperature is below or above, respectively, a given temperature, which may be set and/or adjusted through soft freeze control interface 170, shown in FIG. 1. As such, controller 130 maintains a desired temperature within storage compartment 154 independently from a temperature within freezer storage compartment 104 for storing a specific food item, such as meat and/or ice cream, within storage compartment 154. In a particular embodiment, controller 130 maintains storage compartment 154 at a temperature different than the temperature within freezer storage compartment 104.

In the exemplary embodiment, during a soft freeze mode, controller 130 closes the damper, deactivates the fan and activates heater 164 to facilitate heating the air within storage compartment 154. In a particular embodiment, controller 130 maintains storage compartment 154 at a temperature higher than that of freezer storage compartment 104, such as for example at a temperature of about 7° F. to about 28° F. Controller 130 activates or deactivates heater 164 when the sensed temperature is below or above, respectively, a selected or inputted temperature. Further, upon thermistor 166 detecting a current temperature within storage compartment 154 substantially similar to the selected or inputted temperature, controller 130 deactivates the heater in response to a corresponding signal received from thermistor 166. As such, controller 130 maintains a temperature within storage compartment 154 independently from a temperature within freezer storage compartment 104. In an alternative embodiment, controller 130 includes an open loop having a suitable timer to control the operation of heater 164 in the soft freeze mode.

The above-described system and method for independently controlling a temperature within a soft freeze storage compartment facilitates maintaining food items, such as meat products and ice cream, frozen to a desired hardness. By interfacing with the soft freeze control interface, the consumer is able to activate the soft freeze mode to maintain food items contained within the soft freeze storage compartment frozen to the desired hardness based at least partially on the type of food, a hardness preference and/or a temperature.

Exemplary embodiments of a system and method for independently controlling a temperature within a soft freeze assembly are described above in detail. The system and method are not limited to the specific embodiments described herein, but rather, components of the system and/or steps of the method may be utilized independently and separately from other components and/or steps described herein. Further, the described system components and/or method steps can also be defined in, or used in combination with, other systems and/or methods, and are not limited to practice with only the system and method as described herein.

While the invention has been described in terms of various specific embodiments, those skilled in the art will recognize that the invention can be practiced with modification within the spirit and scope of the claims.

What is claimed is:

1. A soft freeze assembly for a refrigerator including a freezer storage compartment having a first temperature and a refrigerator storage compartment having a second temperature, the freezer storage compartment at least partially defined by a freezer door, said soft freeze assembly comprising:

a second storage compartment positioned within the freezer storage compartment and coupled to the freezer door;

a heat source positioned within said second storage compartment and configured to heat air within said second storage compartment to a third temperature greater than the first temperature within said freezer storage compartment and less than the second temperature within said refrigerator storage compartment; and a controller in operational control communication with said heat source, said controller configured to operate said heat source.

2. A soft freeze assembly in accordance with claim 1 further comprising a feedback device positioned with respect to said second storage compartment, said feedback device configured to facilitate maintaining the third temperature within said second storage compartment independently from the first temperature within said freezer storage compartment and the second temperature within said refrigerator storage compartment.

3. A soft freeze assembly in accordance with claim 2 wherein said feedback device further comprises a temperature sensor positioned with respect to said second storage compartment, said temperature sensor configured to detect a current temperature within said second storage compartment.

4. A soft freeze assembly in accordance with claim 3 wherein said controller is in signal communication with said temperature sensor, said controller configured to activate said heat source to heat the air within said second storage compartment to the third temperature in response to a signal received from said temperature sensor.

5. A soft freeze assembly in accordance with claim 4 wherein said controller is configured to deactivate said heat source in response to a signal received from said temperature sensor indicating the third temperature within said second storage compartment.

6. A soft freeze assembly in accordance with claim 1 further comprising a control interface operatively coupled to said controller, said control interface configured to prompt a consumer to select at least one of a food type, a food hardness preference and the third temperature.

7. A soft freeze assembly in accordance with claim 1 further comprising a damper configured to control air flow through said second storage compartment.

8. A refrigerator comprising:

a freezer storage compartment having a first temperature;

a freezer door at least partially defining said freezer storage compartment;

a refrigerator storage compartment having a second temperature; and a soft freeze assembly mounted within said freezer storage compartment and coupled to said freezer door, said soft freeze assembly comprising:

a second storage compartment;

a heat source positioned within said second storage compartment and configured to heat air within said second storage compartment to a third temperature greater than the first temperature within said freezer storage compartment and less than the second temperature within said refrigerator storage compartment;

a temperature sensor positioned with respect to said second storage compartment and configured to detect a temperature within said second storage compartment; and a controller operatively coupled to said temperature sensor, said controller in operational control communication with said heat source and configured to maintain the third temperature within said second storage compartment independent from the first temperature within said freezer storage compartment and the second temperature within said refrigerator storage compartment.

9. A refrigerator in accordance with claim 8 wherein said second storage compartment is thermally isolated from said freezer storage compartment.

10. A refrigerator in accordance with claim 8 wherein said controller is configured to activate said heat source to heat the air within said second storage compartment to the third temperature in response to a signal received from said temperature sensor.

11. A refrigerator in accordance with claim 8 further comprising a control interface operatively coupled to said controller, said control interface configured to prompt a consumer to select at least one of a food type, a food hardness preference and the third temperature.

12. A refrigerator in accordance with claim 8 further comprising a damper configured to control air flow through said second storage compartment.

13. A refrigerator in accordance with claim 10 wherein said controller is configured to deactivate said heat source in response to a signal received from said temperature sensor upon detecting the third temperature within said second storage compartment.

14. A method for freezing a food item within a refrigerator, said method comprising:

providing a freezer storage compartment having a first temperature, the freezer storage compartment at least partially defined by a freezer door;

providing a refrigerator storage compartment having a second temperature;

positioning a soft freeze assembly within the freezer compartment and coupled to the freezer door, the soft freeze assembly comprising a second storage compartment, a heat source positioned within the second storage compartment and configured to heat air within the second storage compartment, and a temperature sensor positioned with respect to the second storage compartment, the temperature sensor configured to detect a temperature within the second storage compartment; and operatively coupling a controller to the temperature sensor and the heat source, the controller configured to maintain a third temperature within the second storage compartment independent from the first temperature within the freezer storage compartment and the second temperature within the refrigerator storage compartment.

15. A method in accordance with claim 14 further comprising heating the air within the second storage compartment to the third temperature greater than the first temperature and less than the second temperature.

16. A method in accordance with claim 14 further comprising activating the heat source to heat the air within the second storage compartment to the third temperature in response to a signal received from the temperature sensor.

17. A method in accordance with claim 14 further comprising operatively coupling a control interface to the controller, the control interface configured to prompt a consumer to select at least one of a food type, a food hardness preference and the third temperature.

18. A method in accordance with claim 16 further comprising deactivating the heat source in response to a signal received from the temperature sensor upon detecting the third temperature within the second storage compartment.

* * * * *